US005200260A

United States Patent [19]

Hsu

[11] Patent Number: 5,200,260

[45] Date of Patent: Apr. 6, 1993

[54] NEEDLED PAPERMAKING FELT

[75] Inventor: Chien-Yeh Hsu, Greer, S.C.

[73] Assignee: Wangner Systems Corporation, Greenville, S.C.

[21] Appl. No.: 835,549

[22] Filed: Feb. 14, 1992

[51] Int. Cl.[5] ..... B32B 5/06; B32B 27/02; D21F 3/02; D21F 7/08

[52] U.S. Cl. ..... 428/234; 28/107; 162/358.2; 162/900

[58] Field of Search ..... 162/358.2, 900; 428/234; 28/107

[56] References Cited

U.S. PATENT DOCUMENTS

| | | | |
|---|---|---|---|
| 4,359,501 | 11/1982 | DiTullio | 428/245 |
| 4,820,571 | 4/1989 | Searfass | 428/225 |
| 4,840,383 | 6/1989 | Wyss | 428/234 |
| 4,892,780 | 1/1990 | Cochran et al. | 428/234 |
| 4,929,478 | 5/1990 | Conaghan et al. | 428/35.1 |
| 4,954,605 | 9/1990 | Deeg | 528/125 |
| 4,970,284 | 11/1990 | Staniland | 528/125 |
| 5,023,132 | 6/1991 | Stanley et al. | 428/234 |

*Primary Examiner*—James C. Cannon
*Attorney, Agent, or Firm*—Cort Flint

[57] ABSTRACT

A papermaking press fabric for use with impulse drying machinery having a base fabric formed of nylon filament machine direction and cross-machine direction yarns. A fiber batt formed of polyetheretherketone (PEEK) fibers secured to at least a support surface in such a manner as to encapsulate and insulate the base fabric. The resulting press fabric is capable of operating in temperatures of up to 700° F. while exhibiting superior resistance to compacting and wear.

20 Claims, 2 Drawing Sheets

NEEDLED PAPERMAKING FELT

This invention relates to a papermaking press felt for use with impulse drying presses.

BACKGROUND OF THE INVENTION

Papermaking machines are divided into three dewatering sections; the forming section, the press section, and the drying section. Each section employs a papermaking fabric which serves as a dewatering and conveying medium.

The forming section receives a paper forming slurry of pulp which is approximately only 0.5% solid material. The slurry is delivered on to a forming fabric which acts to drain the water from the slurry to a point that the solid content is increased to between 18% and 23%, and slurry of pulp is formed into a sheet.

The press section receives the sheet of pulp onto a press fabric, which in cooperation with press rolls, further drains the water to increase the solid content of the sheet of pulp to between 36% and 44%.

An advanced process now employed in the press section is impulse drying. This novel process involves pressing briefly the moist sheet with a roll heated to a temperature of between 470° and 700° F. This process of intense heat transfer gives significantly higher dryness that wet pressing while using less energy than the conventional cylinder drying.

Normally wet felts consist of a woven base fabric formed of synthetic monofilament yarns, usually polyamide (nylon). Nylon exhibits super mechanical properties, such as good wearability, flexibility and dimensional stability. A fiber batt is normally secured to the base fabric by needling. The fiber batt is generally formed of staple length synthetic fibers such as polyesters, polyamides and in some instances polypropylene.

These synthetic fibers do not have the physical capability to operate with the high temperatures used in impulse drying. In order to overcome this disadvantage, fiber batts formed of staple fibers of a polymer of m-phenylenediamine and isophthaloyl chloride known as Nomex or an aramid known as Kelvar have been used for high temperature applications. Fiber batts formed of these synthetic materials while having the capacity to operate at high temperatures show poor mechanical properties such as: poor wearability and poor compaction resistance.

Polyaryletherketones, including polyetheretherketone, monofilaments have been employed in belts for drying ovens as illustrated by U.S. Pat. Nos. 4,359,501 and 4,820,571. Due to the excessive cost of the material, these products have not generally been accepted by industry.

It is an object of this invention to produce a papermaking press fabric which overcomes the disadvantages of the prior art as indicated above.

It is another object of the invention to provide a papermaking press felt having the elasticity characteristics and wearability characteristics of nylon so that the fabric will have superior runability on the paper machine.

SUMMARY OF THE INVENTION

A papermaking press fabric for use on the paper machine consisting of a base fabric having machine direction and cross-machine direction monofilament yarns inter-associated to present an upper support surface and an inner lower surface. The machine direction yarns and the cross-machine direction yarns are polyamide. The batt fibers are formed of cut filaments of polyetheretherketone (PEEK) polymers. The papermaking press fabric may be woven in any of a number of weave patterns to include a plain weave, a duplex weave, a twill or modified twill weave, and a satin weave.

The machine direction yarns may have a circular cross-section with a diameter of between 0.012 and 0.03 inches, or they may be substantially rectangular in cross-section and have a height of between 0.010 to 0.030 inches and a width of between 0.02 and 0.04 inches.

The fiber batt is formed of PEEK fibers of between 3 and 60 denier, and is needled to the support surface or to both the support surface and the lower surface of the base fabric. The batt can be a single layer or it may be multi-layered depending on the design of the felt. The batt in all instances is secured to the base fabric so as to encapsulate and insulate the fabric.

A papermaking press fabric for use on a papermaking machine including a base fabric formed of machine direction and cross-machine direction polyamide monofilament warp and weft yarns interwoven to form single, double, or triple layer fabrics. The machine direction yarns may be circular, or rectangular in cross-section and the cross-machine yarns may be circular or rectangular in cross-section.

A papermaker wet end felt for use with impulse drying equipment comprising a base fabric having a top surface and a bottom surface. The base fabric includes a plurality of nylon monofilament warp yarns interwoven with a plurality of nylon monofilament, weft yarns each having a diameter of between 0.012 and 0.030 inches. The base fabric is heat set after weaving. A fiber batt formed of PEEK fibers is secured to the base fabric in such a manner as to cover the top and bottom surfaces thereof. The fiber batt consist of melt extruded filaments cut to fiber length. The filaments are formed of polymers of the group including polyetheretherketone which has repeating monomers of two ether groups and a ketone group.

When the felt is subjected to rolls heated to approximately 500° F. the batt acts to insulate the nylon base fabric.

The batt is normally needled to one surface of the base fabric. It may comprise two batts needled to the base fabric on the upper and lower surface. The fibers forming the batt are of a denier between 3 and 60 and are arranged at a density of between 0.10 and 0.60 grams per cubic centimeter. In some instances the fibers forming the batt are of a plurality of diameters. Also the batt may comprise a plurality of fiber layers. The fibers forming each of the layers may be of different sizes.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
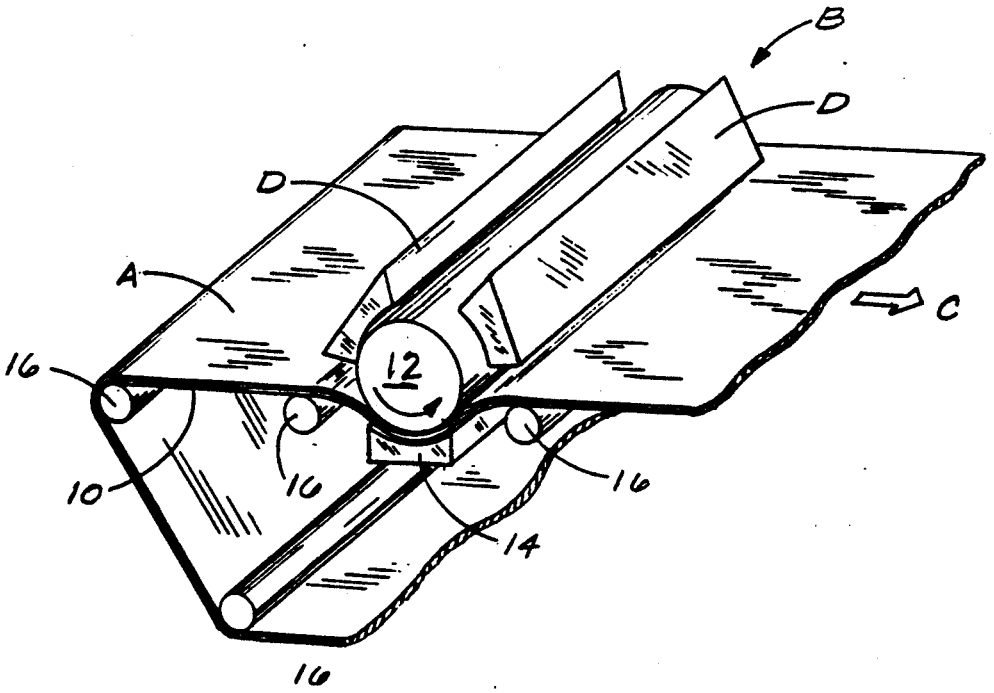
FIG. 1 is a diagrammatic view of the impulse drying a paper machine.

Referring now to the drawings, FIG. 1 illustrates a schematic representation of a press section of a paper machine. Normally, the papermaking process includes a forming section, a press section and a dryer section. Since the instant invention is primarily directed to a press fabric, only that section has been shown.

The paper sheet A is formed in the forming section and is delivered to the press section B by suitable means. Here, it is brought into contact with press felt or fabric 10. The press felt 10 is driven in the direction of arrow C so as to carry paper sheet A into engagement with at least one nip roll 12 which operates in concert with a long nip press 14. The heating elements D, which are arranged adjacent to the upper surface of roll 12 act to elevate the roll temperature to between 470° and 500° F. so that the moisture in the paper sheet is removed by both heat and pressure. Here, most excess water is removed from sheet A preparing it for drying in the dryer section.

While only a single nip roll 12 and press 14 is shown, various selected numbers and configuration of press sections may be arranged in tandem as the moisture removal and finishing requirements vary between products.

As illustrated in FIG. 1, as paper sheet A moves into the press area, nip roll 12 comes into direct contact with the paper sheet. Press fabric 10 carrying paper sheet A separates nip press 14 from direct contact with the paper sheet A. The nip of nip roll 12 and press 14 extract a desired amount of fluid from the paper sheet A which is then moved on by fabric 10 and suitable guide rolls 16 to the dryer section. Once the paper web A is removed from fabric 10, which is endless, it continues around guides 16 so that a portion thereof is always presented to the continually supplied paper sheet A and the drying process continues uninterrupted.

The nip pressure between nip roll 12 and nip press 14 may range between 200 to 2000 pounds per linear inch. Such pressures are intended to squeeze the water from paper web A; however, to be effective, the water must also drain through fabric 10, otherwise it will only be reabsorbed in web A. In some instances, the fabric passes over a vacuum section to remove the excessive water before returning to the web receiving position.

It is usual to form fabric 10 of a construction which provides voids or passageways therethrough to allow the water squeezed from web A to pass through fabric 10 and away from the web. It is also important that the support surface of fabric 10 be as smooth as possible with a minimum of surface irregularities which tend to mark the web.

The production of paper of different characteristics require different arrangements in the papermaking machine and different constructions of the press fabrics. For example, the number of stations in the press section may vary and/or the speed at which the web passes through the section may vary. These variances require papermaking fabrics possessing different structures and capabilities. A constant always is that the papermaking fabric possess good strength, good stability, and good wearability. The fabric must also possess uniform absorption and drainage characteristics and have good resistance to compression and degradation when exposed to hot moist conditions.

Figure 4:
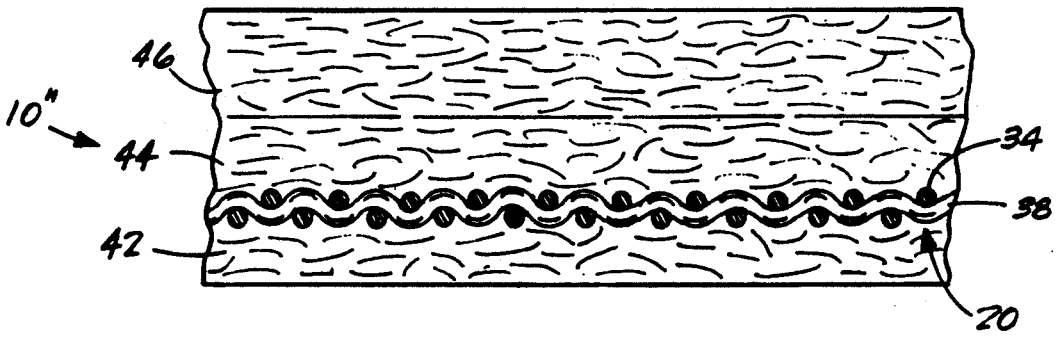
Figure 2:
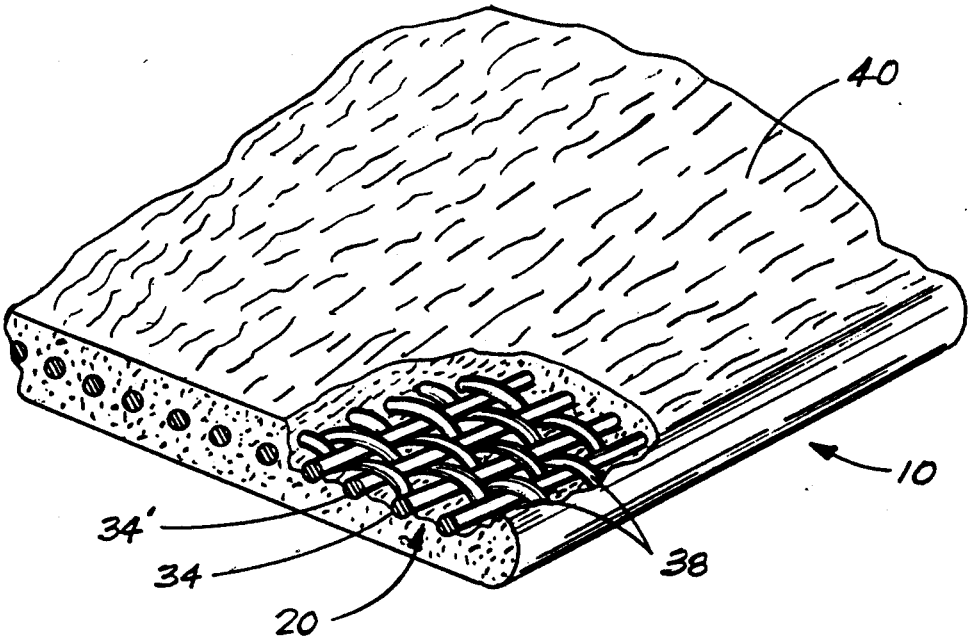
FIG. 2 is a sectional perspective view of a fabric according to the invention showing the base fabric in cut away section encapsulated with a fiber batt.
Figure 3:
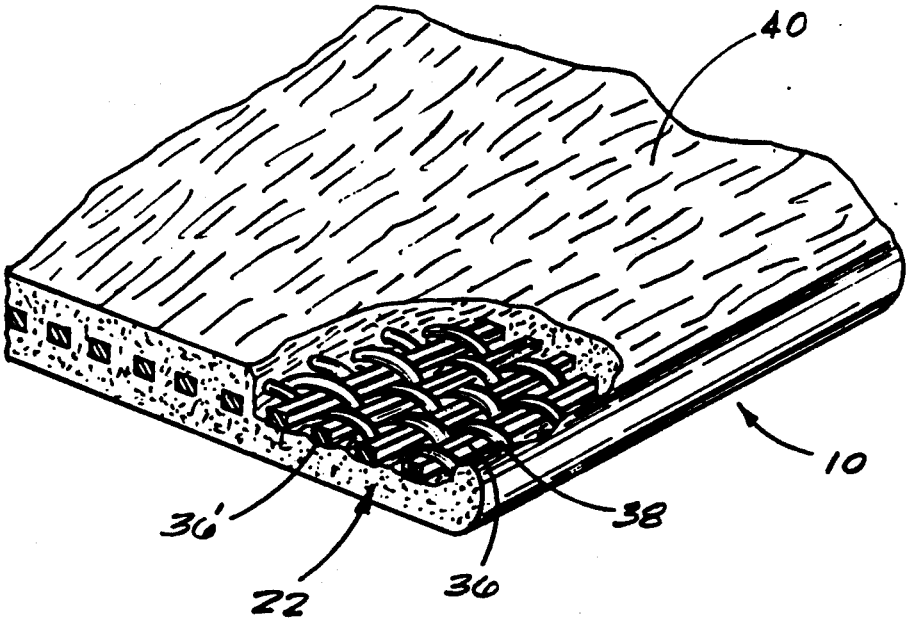
FIG. 3 is a sectional perspective view of a press fabric similar to FIG. 2 showing the base fabric woven with warp yarns having a rectangular cross-sectional configuration; and, FIG. 4 is a sectional side view of a press fabric a according to the invention in which a fiber batt is attached to each fabric surface and an additional fiber batt is secured to the upper of the support fabric.

In the instant invention the fabrics for use in the press section of the papermaking machine are preferably woven, as illustrated in FIGS. 2, 3 and 4. Anyone of several usual weaves are acceptable. The fabric will have a fiber batt attached to its support surface to extend through the fabric and cover both surfaces as shown at 40 in FIGS. 2 and 3 or a fiber batt may be attached to both surfaces as shown at 42 and 44 in FIG. 4. In the embodiment shown a second fiber batt 46 may be attached to the upper surface of fiber batt 44.

Rectangular cross-section filaments have the advantage of forming a lower profile fabric while at the same time presenting a fuller or more smooth support surface for the paper forming product. Circular monofilaments provide greater drainage capabilities.

Alternate embodiments can be seen in FIGS. 2 and 3. FIG. 2 shows a base fabric 20 in which warp monofilaments 34 extend in the machine direction and interweave with cross-machine weft yarns 38, in a plain weave. The warp filaments 34 along with weft filaments 38, are formed of polyamide (nylon) although other synthetic materials or blends might be used. Warp 34 is formed to have a circular cross-section, as seen at 34' in FIG. 2. In the embodiment shown in FIG. 3 monofilament warp yarns 36 have a rectangular cross-section as shown at 36 and weave in a plain weave with monofilament weft yarns 38.

In still another embodiment shown in FIG. 4, press felt 10' is formed of a base fabric 20 woven in a plane weave with monofilament warp yarns 34 and monofilament weft yarns 38. After base fabric 20 is stabilized by heat setting, it is in condition to receive a fiber batt. Fiber batt 42 is attached to a lower surface of the base fabric and fiber batt 44 is attached to the upper surface of the base fabric. An additional fiber batt 46 is then attached to the upper surface of batt 44 so that a double layered batt is provided to receive the paper web.

The monofilaments employed as weft most desirably are circular in cross-section as shown in FIGS. 2, 3 and 4; however in certain circumstances filaments having a rectangular cross-section could be used.

The woven press fabric of the invention is not limited to the structure shown in FIG. 2, 3 and 4, but could also be a multi layer fabric.

Various other weave patterns such as twill, modified twill, sateen, and triplex weaves may also be employed depending upon the intended use and product. Normally, the end or yarn count will range between 36 and 64 in the warp direction and between 24 and 34 in the weft direction. The rectangular monofilaments range in height between 0.010 inch and 0.025 inch, in width between 0.02 inch and 0.035 and have a width/height ration in the vicinity of 2 to 1. The monofilaments with a circular cross-section range in diameter between 0.012 into 0.03 inch. In certain instances the circular monofilaments may be united in bundle form forming multifilament yarns of the same general diameters.

Nylon is the most desirable material for forming base fabric 20, because of its elasticity, stability and wearability. Nylon begins to degrade at 400° F. and consequently cannot be used to form the fiber batt of press felts operating with impulse drying machines. Certain other staple fibers such as Nomex or Kevlar have been employed with limited success. These fibers have the capability to operate at higher temperatures and will function to insulate the base fabric from high temperature. Nomex and Kevlar, however, exhibit poor mechanical properties as they have a tendency to stain, to compact and to wear excessively, thereby inhibiting the porosity and life expectancy of the press fabric.

In the present invention, fibers of polyaryletherketone polymers, particularly polyetheretherketone (PEEK), have been found particularly advantageous for use as the batt material in a press fabric. In the preferred embodiment, cut staple fiber batts, as shown at 40, 42, 44 and 46, formed of polyetheretherketone (PEEK), when attached to nylon base fabric 20, as shown in FIGS. 2 and 3, have been found to insulate the base fabric from temperatures as high as 700° F. These fiber batts may consist of a single batt 40 needled to a top surface to extend through base fabric 20 or 22 as shown in FIGS. 2 and 3 or they may consist of a plurality of fiber batts 42, 44 and 46 needled to both surfaces of the base fabric 20 as shown in FIG. 4. The construction of the fiber batts vary in density and porosity depending on the intended paper products being formed. Certain products require a smooth surface which leaves substantially no marks, while others require more open areas. Generally, the fibers forming the batt have a denier range of from 3 to 60 with the weight basis ranging between 0.25 oz per square foot to about 1.5 oz per square foot and the density being between 0.10 and 0.60 grams per cubic centimeter. The fibers are cut from multi-extruded filaments to a length of between 2" and 6".

Press felts formed with PEEK batts as above described are formed to have an air permeability of between 20 to 160 cubic feet per minute and a caliper ranging between 0.110 and 0.300 of an inch. Because of the superior mechanical qualities of the PEEK fibers, these batts resist compaction when exposed to intense pressure at high moist temperatures. This allows the press felt to maintain its porosity and caliper within required limits throughout the life of the fabric. Also the life expectancy of the press felt is extended beyond that of other know felts because of the high degree of resistance to wear exhibited by PEEK fibers.

The polyetheretherketone (PEEK) polymers suitable for use as cut staple fibers of this invention consist of two ether groups and one ketone group. Suitable monofilament strand material is manufactured by Imperial Chemical Industries of Lo England from resin identified by the name Zyex.

The base fabric 20 or 22 of the press or wet felt is completely encapsulated by the fibers of the fiber batt 40. The PEEK fibers act as insulation allowing the nylon base fabric to operate in the high temperatures of the impulse drying equipment without degrading.

While a preferred embodiment of the invention has been described using specific terms, such description is for illustrative purposes only, and it is to be understood that changes and variations may be made without departing from the spirit or scope of the following claims.

What is claimed is:

1. A papermaker wet end felt for use with impulse drying equipment comprising a base fabric having a top surface and a bottom surface, said fabric including a plurality of nylon monofilament warp yarns interwoven with a plurality of nylon monofilament yarns each having a diameter of between 0.012 and 0.030 inches;

a fiber batt secured to said base fabric in a manner as to cover said top and bottom surfaces, said fiber batt consisting of fibers of multi extruded filaments selected from the group consisting of polyetheretherketone having repeating units of two ether groups and one ketone group; whereby, when said felt is subjected to heated rolls said batt acts to insulate said nylon base fabric so that it may function in temperatures of up to 700° F. without excessive degradation.

2. The felt of claim 1 wherein said fiber batt is needled to one of said surfaces of said base fabric.

3. The felt of claim 1 wherein said fiber batt is needled to said base fabric from said upper surface and a second fiber batt is needled to said lower surface.

4. The felt of claim 1 wherein said fibers, forming said fiber batt have a denier of between 3 and 60.

5. The felt of claim 1 wherein said batt fibers are arranged at a density of between 0.10 and 0.60 grams per cubic centimeter.

6. The felt of claim 1 wherein at least one of the warp and weft yarns of the base fabric comprise round monofilaments of a diameter between 0.012 and 0.03 inches.

7. The felt of claim 1 wherein at least one of the warp and weft yarns comprise shaped monofilaments having a height of between 0.010 to 0.025 inches and a width of between 0.02 and 0.035 inches.

8. The felt of claim 1 wherein said base fabric is heat set after weaving.

9. The felt of claim 1 wherein said fibers forming said fiber batt are of a plurality of diameters.

10. The felt of claim 1 wherein said fiber batt comprises a plurality of fiber layers.

11. The felt of claim 10 wherein said fibers forming said layers are of difference sizes.

12. A papermaker wet end felt for use with an impulse drying machine comprising a base fabric having an upper surface and a lower surface formed of synthetic monofilament machine direction and cross machine direction yarns;

a fiber batt formed of cut staple polyetheretherketone filaments secured to said base fabric by needling so as to encapsulate said base fabric;

said fiber batt being formed to weigh between 0.25 and 1.5 ounces per square foot and to have an air permeability of between 20 and 160 cubic feet per minute;

said fiber batt functioning to insulate said base fabric from temperatures of approximately 500° F. while maintaining said weight and porosity within said ranges over an extended work life.

13. The felt of claim 12, wherein at least said machine direction monofilament yarns are polyamide.

14. The felt of claim 12, wherein said felt is formed with a caliper of between 0.110 and 0.30 of an inch.

15. The felt of claim 12, wherein said fiber batt is needled to said upper surface.

16. The felt of claim 15, wherein a second fiber batt is needled to said lower surface.

17. A papermaker wet end felt for use with high temperature drying apparatus comprising;

a base fabric woven of synthetic monofilament machine directions yarns and cross machine direction yarns to have an upper paper product support surface and a lower roll contacting surface;

a fiber batt secured to and encapsulating said base fabric in such a manner as to form an insulating shield;

said fiber batt being formed of staple fibers of between 3 to 60 denier having a length of between 2 and 6 inches;

said fibers consisting of polyaryletherketone polymers; whereby said felt may operate in temperatures at least up to 500° F. while maintaining desired resilience and permeability.

18. The felt of claim 17 wherein said fibers consist of polyetheretherketone.

19. A method of constructing a high temperature resistant papermaking fabric of the type which includes a woven base fabric having a fibrous batt needled thereto so as to encapsulate said base fabric, wherein the method comprises:

including in said fibrous batt fibers selected from a group of polyaryletherketone polymer fibers which are needled into said base fabric.

20. The method of claim 19 wherein selecting said fibers to consist of polyetheretherketone.

* * * * *